United States Patent [19]

Nogi et al.

[11] Patent Number: 4,556,212

[45] Date of Patent: Dec. 3, 1985

[54] STACKER FOR PAPER SHEET COUNTING APPARATUS

[75] Inventors: Hiroyoshi Nogi, Tokyo; Shigeru Tanaka, Kashiwa, both of Japan

[73] Assignee: Musashi Engineering Kabushiki Kaisha, Tokyo, Japan

[21] Appl. No.: 606,983

[22] Filed: May 4, 1984

[30] Foreign Application Priority Data

May 13, 1983 [JP] Japan ..... 58-82780

[51] Int. Cl.[4] ..... B65H 29/00

[52] U.S. Cl. ..... 271/315; 271/187

[58] Field of Search ..... 271/187, 315

[56] References Cited

U.S. PATENT DOCUMENTS 3,096,089 7/1963 Swenker ..... 271/293
3,355,169 11/1967 Seyl ..... 271/82 X
4,127,265 11/1978 Wirz ..... 271/82 X
4,351,520 9/1982 Tanaka ..... 271/315
4,363,584 12/1982 Kokubo ..... 271/315 X

*Primary Examiner*—Richard A. Schacher
*Attorney, Agent, or Firm*—Brooks Haidt Haffner & Delahunty

[57] ABSTRACT

The stacker for a paper sheet counting apparatus of the present invention has a rotatable drum and a plurality of rigid, substantially L-shaped blade members mounted on and around the drum periphery in equally spaced apart relation to one another. Each blade member has one end mounted for limited, free pivotal movement on the drum and its other and extending in a direction opposite to the intended rotational direction of the drum, the pivotal movement of each blade being responsive to rotation of the drum in such manner that the radius of rotation of said radial distance of projection of its other end away from the drum periphery is increased and decreased during rotation of the drum.

4 Claims, 2 Drawing Figures

STACKER FOR PAPER SHEET COUNTING APPARATUS

BACKGROUND OF THE INVENTION

This invention relates to a paper sheet counting apparatus and more particularly to a stacker for such apparatus, by means of which paper sheets such as banknotes that are taken out of a hopper of the counting apparatus and counted by a counting mechanism are stacked in trim order through use of a rotary drum provided with blade members.

In such a stacker, the paper sheets taken out intermittently from the hopper are accommodated between adjoining blade members of the rotary drum rotated synchronously with an extracting roll so as to be sequentially stacked on the stacker. In the conventional stacker, the blade members are securely mounted to the drum, as disclosed for example in the Japanese Laid-open Utility Model Publication No. 81-122168, so that the gap between adjoining blade members has a constant magnitude at all times.

However, the paper sheets extracted intermittently by the extracting roll are subjected to slipping with respect to the surface of the extracting roll under various operating conditions. Therefore, the paper sheets are not necessarily maintained at equal intervals from one another when supplied to the rotary drum. Thus the paper sheets are not necessarily supplied to the gap between adjoining blade members, but may occasionally abut on the tip ends of the blade members, or the leading ends of the paper sheets may be acted upon by the trailing ends of the preceding sheets, to be accidentally ejected out of the stacker.

Such inconvenience might possibly be eliminated by enlarging the gap between the adjoining blade members and thereby the distance between the tip ends of these members, by enlarging the radial size of the drum and thereby increasing the circumferential size of the drum at the tip ends of the blade members. However, this is not fully satisfactory for obviating the above inconvenience, because reduced overall height and faster counting speed are always required of the paper sheet counting apparatus.

SUMMARY OF THE INVENTION

It is a principal object of the present invention to provide a stacker for a paper sheet counting apparatus wherein the opening space between adjoining blade members is automatically enlarged without enlarging the size of the drum of the counting apparatus for effectively preventing paper sheets from being accidentally ejected out of the stacker.

The above and other objects of the present invention are accomplished by a stacker for a paper sheet counting apparatus comprising a rotatable drum, and a plurality of rigid, substantially, L-shaped blade members mounted on and around the periphery of the drum in equally spaced apart relation to each other, each of said blade members having one end mounted for limited arcuate movement substantially on the periphery of the drum and its other, free end extending in a direction opposite to the intended rotational direction of the drum, said one end being freely mounted in such a manner that its limited arcuate pivotal movement in one direction or the other respectively and automatically increases or decreases the distance of radial projection of its other end is away from the drum periphery during rotation of the drum.

DESCRIPTION OF THE DRAWINGS

The invention will become more readily apparent from the following description of a preferred embodiment thereof shown, by way of example only, in the accompanying drawings, in which.

DETAILED DESCRIPTION OF THE EMBODIMENT

A preferred embodiment of the present invention is now described by referring to the accompanying drawings.

Figure 1:
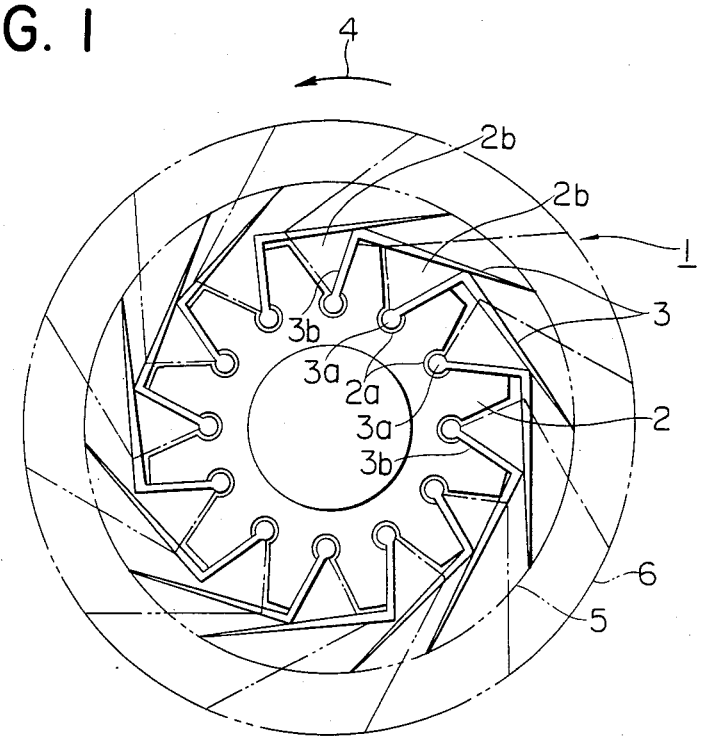
FIG. 1 is a diagrammatic side view showing a rotary drum in accordance with the present invention.

Referring to FIG. 1, there is shown a rotatable drum 1 of the present invention, in schematic side view, including a plurality of rigid blade members 3 mounted in equally spaced apart relation substantially on and around the periphery of a main body 2 of the drum 1. Each blade member 3 is substantially L-shaped to provide first and second length portions, the first length portion **3*b* having one end pivotally mounted on the main body 2 and the second length portion having its free end extending in a direction opposite to the intended rotational direction of the drum shown by an arrow mark 4**.

For movable attachment of the blade member 3, the end of its first length portion **3*b* is formed as a shaft 3*a* which is accommodated in a substantially cylindrical recess 2*a* in the main body 2 of the drum 1. The recess 2*a* is slightly larger in diameter than said one end shaft 3*a* to permit limited but freely pivotal movement of the blade member first length portion 3*b* within the recess 2. Although not shown, a suitable stopper is provided for inhibiting movement of the blade member 3 axially of the drum 1. For permitting such limited pivotal movement of the blade member 3 upon such limited pivotal movement of the one end shaft 3*a*, a substantially V-shaped groove 2*b* is formed in the main body 2 in radial communication with said recess 2*a* for accommodating base the first length portion 3*b* of the L-shaped blade member 3**.

It is seen from FIG. 1 that, when the first length portion **3*b* of the blade member 3 is close to the upstream side wall of the recess 2*b* relative to the rotational direction of the drum 1, the tip end of each blade member 3 is situated on a circle 5 and, when the portion 3*b* is close to the downstream side wall of the recess 2*b*, as schematically shown by a chain-dotted line showing the center axis of the blade member 3, said tip end is situated on a circle 6, the radius of which is larger than that of the circle 5**.

Figure 2:
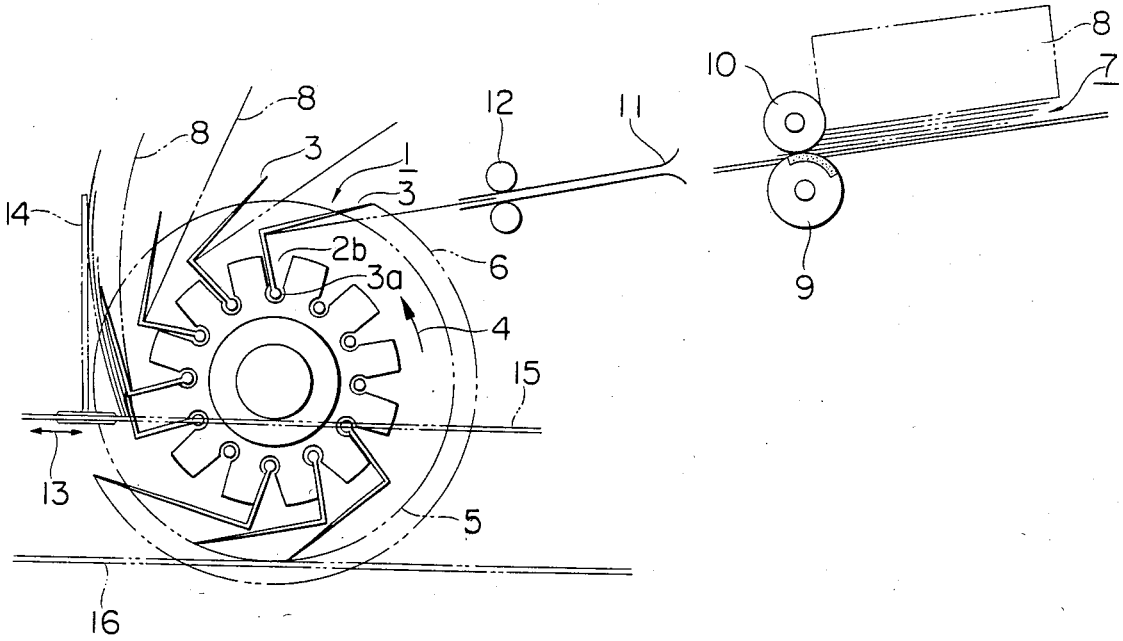
FIG. 2 is a diagrammatic side view showing a stacker equipped with the rotary drum shown in FIG. 1.

The operation of the rotatable drum 1 is now explained by referring to FIG. 2. Although only several blade members are shown in FIG. 2 as being mounted on the drum 1 for simplicity, the blade members are mounted in effect on the overall circumference of the drum 1 at equal angular intervals from each other.

Referring to FIG. 2, a number of paper sheets 8 stacked in a hopper 7 are taken out of the hopper one by one upon the operation of an extracting roll 9 having a highly frictional peripheral portion and a separating roll 10 placed over roll 9. The paper sheets thus taken out are guided through guide plates 11 between a pair of feed-out rolls 12 and thus supplied to the drum 1. Since the drum is rotating in the direction shown by the arrow 4, the blade members 3 are erected under the centrifugal force and are turned about ends 3*a* thereof so as to be shifted away from the upstream side wall and towards the downstream side wall of the recess 2*b* relative to the rotational direction of the drum. Thus, the blade members are at the position shown by the solid lines in FIG. 2. When the blade members 3 are in this position, their tip ends are moved on the circle 6 larger in diameter than the circle 5, so that the extent of the opening between adjacent blade members, or the distance between the adjoining tip ends of the members, is increased by a fraction of a value equal to the circumferential difference of the circles 5, 6 divided by the number of the blade members 3.

Each paper sheet 8 is accommodated in the thus extended gap between adjacent blades without causing the aforementioned inconvenience of the prior art. In the neighborhood of the rotatable drum 1 and at the downstream side in the proceeding direction of the sheets 8, a paper sheet rest plate 14 is mounted so as to be movable in the direction of the arrow mark 13. When a preceding blade member abuts on the sheet rest plate 14, the rest plate is pushed away from drum 1, while simultaneously the preceding blade member is biased towards the next succeeding blade member. Thus the paper sheet is firmly clamped between the two blade members. As the drum is turned further, the paper sheet 8 abuts on a bottom plate 15 mounted around the drum 1 which is so sized and shaped that the blade members 3 may travel therepast but the passage of the paper sheet is positively inhibited. In this manner, the paper sheets are released from the gap between the adjoining blade members and are placed in trim order.

After passing through the bottom plate 15, the tip ends of the blade members 3 are again caused to travel on the circle 6. However, with rotation of the drum 1, the tip ends of the blade members 3 abut on a bottom plate 16 of the paper sheet counting apparatus. Thus, with further revolution of the drum 1, the tip ends of the blade members 3 are again caused to travel on the smaller circle 5.

Thus, a predetermined number of paper sheets are placed in trim order on the rest plate 14 by a sequence of the aforementioned operations.

It is seen from above that the present invention provides a stacker for a paper sheet counting apparatus in which the one ends of the blade members are movably mounted on the drum in such a manner that the radius of rotation of the other ends of the blade members is increased during rotation of the drum. In this manner, even when the outside diameter of the drum need be limited because of design size limitations of the main body of the counting apparatus, it is possible to reduce the overall size of the drum to that corresponding to the tip ends of the blade members lying on the circle 5 while permitting the gap size between the adjoining blades to be increased for accommodating paper sheets.

What is claimed is:

1. A stacker for a paper sheet counting apparatus comprising a rotatable drum, and a plurality of radially projecting blade members mounted substantially on and around the periphery of the drum in equally spaced apart relation from each other, each of said blade members being rigid and having substantially L-shaped configuration to provide first and second length portions of the blade member disposed in angular relation to each other, said first length portion having a free end mounted for freely pivotal movement on said drum for limited arcuate movement of said first length portion along said drum periphery and said second length portion extending from the opposite end of said first length portion in a direction opposite to the intended rotational direction of the drum, whereby the free end of said second length portion moves towards and away from said drum periphery responsive to said limited arcuate movement of said first length portion in respectively opposite directions.

2. The stacker as claimed in claim 1, wherein the peripheral surface of the drum is formed with a plurality of substantially V-shaped grooves corresponding to the respective of said blade members, said free end of each of said blade member first length portions being pivotally mounted at the bottom of its said associated V-shaped groove.

3. The stacker as claimed in claim 2, wherein each said blade member is restrained from rotation during rotation of the drum by said first length portion thereof abutting on the upstream side wall of said recess relative to the rotational direction of the drum.

4. The stacker as claimed in claim 3, wherein said free end of each said blade member first length portion is formed as a shaft extending in the direction of the drum axis, and wherein a cylindrical recess is formed at the bottom of said substantially V-shaped groove to which said free end is pivotally mounted, said recess accommodating said shaft.

* * * * *